United States Patent [19]

Ellsworth

[11] Patent Number: 5,025,279

[45] Date of Patent: Jun. 18, 1991

[54] PROCESS FOR REPLENISHING SOLUTIONS IN A FILM PROCESSOR

[75] Inventor: Roger D. Ellsworth, Rochester, N.Y.

[73] Assignee: Eastman Kodak Company, Rochester, N.Y.

[21] Appl. No.: 496,753

[22] Filed: Mar. 21, 1990

[51] Int. Cl.[5] ..... G03D 3/06; G03D 3/08

[52] U.S. Cl. ..... 354/298; 354/324

[58] Field of Search ..... 354/298, 324

[56] References Cited

U.S. PATENT DOCUMENTS

| | | | |
|---|---|---|---|
| 3,990,088 | 11/1976 | Takita | 354/298 |
| 4,021,832 | 5/1977 | Krehbiel et al. | 354/298 |
| 4,057,817 | 11/1977 | Korb et al. | 354/298 |
| 4,057,818 | 11/1977 | Gaskell et al. | 354/298 |
| 4,104,670 | 8/1978 | Charnley et al. | 354/324 |
| 4,300,828 | 11/1981 | Kaufman | 354/298 X |
| 4,345,831 | 8/1982 | Kachelries | 354/298 |

FOREIGN PATENT DOCUMENTS 0216791 3/1989 European Pat. Off. .

*Primary Examiner*—A. A. Mathews

*Attorney, Agent, or Firm*—G. Herman Childress

[57] ABSTRACT

Processing solutions in a film processor for sheet film, for example, are replenished on the basis of the number of sheets processed during a predetermined time period. A first volume of replenishment solution is added to a tank for the processing solution each time a sheet is processed until a first predetermined number of sheets has been processed. If the number of sheets processed during the time period exceeds the predetermined number, then a smaller volume of replenishment solution is added to the tank.

7 Claims, 2 Drawing Sheets

PROCESS FOR REPLENISHING SOLUTIONS IN A FILM PROCESSOR

FIELD OF THE INVENTION

The present invention relates to a process for replenishment of processing solutions in a radiographic processor and, more particularly, to such a process wherein replenishment of the solution is based on the number of sheets processed during a predetermined period of time.

During processing of film, such as radiographic film, chemical processing solutions contained in tanks in the processor become depleted during processing of the film. To some extent, depletion also occurs by evaporation of the solutions due, in part, to heating of the solutions to a temperature required for processing the film. Therefore, the processing solutions must be replenished periodically in order to maintain the quality of the processing operation.

Replenishment of processing solutions for radiographic processors may be based on the amount of film processed during a period of time. For example, some film processors have a replenishment system that is adjusted at the the time of installation, or later by service personnel, based on the customer's estimate of projected film usage over a specific time period. The manual setting of the replenishment system is determined based on the usage estimate and a chart, furnished by the processor manufacturer, which indicates desired replenishment rates for the amount of film to be processed. The use of this system can result in the volume of replenishment solutions being excessively high or too low based on the customer's inaccurate estimate of the total film usage and possible improper interpretation of the manufacturer's recommended settings for the replenishment rate. Even when the processor has been set correctly to the manufacturer's recommended settings, replenishment may be inaccurate on a short-term basis because this system is not capable of adjusting automatically for varying film usage on an hour-to-hour basis or a day-to-day basis.

It is also known to replenish solutions in a film processor by measuring the density of the film processed, and also by calculating the total area of the film sheets actually processed. However, these systems tend to be complicated and are therefore difficult to build and expensive to install.

SUMMARY OF THE INVENTION

It is an object of the invention to replenish solutions in a film processor in a way which avoids errors due to improper interpretation of the manufacturer's recommended settings of a replenishment system, or inaccurate estimates of film usage. Another object of the invention is to provide a replenishment system based on the quantity of film processed and which is automatically adjusted on a short-term basis for variations in the quantity of film being processed.

In accordance with the present invention, a process is provided for replenishing a solution in a film processor, wherein a series of film sheets are fed seriatim through a tank containing the solution. The process comprises detecting each film sheet fed through the solution and incrementing a counter each time a film sheet is detected during a predetermined time period. The solution in the tank is replenished as a function of the number of processed sheets detected during the time period with the volume of the replenishment solution varying from (1) a first volume when the counter indicates a low number of sheets to (2) a second volume less than the first volume when the counter indicates a higher number of sheets.

The invention, and its objects and advantages, will become more apparent in the Detailed Description of the Preferred Embodiment presented below.

BRIEF DESCRIPTION OF THE DRAWINGS

In the Detailed Description of the Preferred Embodiment of the invention presented below, reference is made to the accompanying drawings in which.

DETAILED DESCRIPTION OF THE PREFERRED EMBODIMENT

Figure 1:
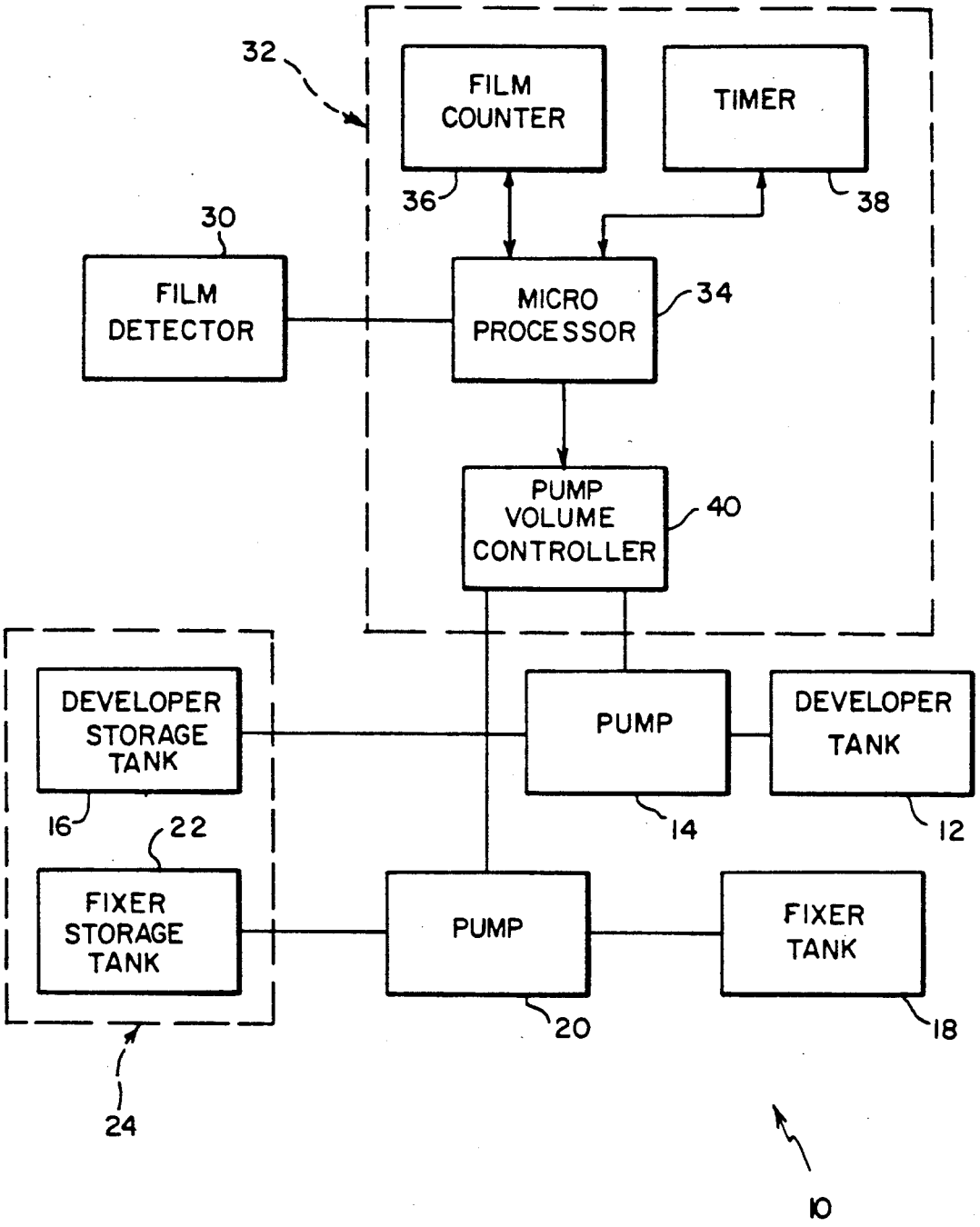
FIG. 1 is a diagrammatic view illustrating apparatus for carrying out the process of the invention.

The process of the present invention relates to replenishment of one or more solutions in a firm processor generally designated 10 in FIG. 1. Known film processors comprise a developer tank as shown at 12 for a chemical solution used for developing latent images on photographic prints fed through the solution in tank 12. Portions of the developer solution are depleted during development of the latent images, and portion of the solution can also be depleted due to evaporation. Accordingly, conventional film processors include a pump 14 which is adapted to transfer a replenishment developer solution from a storage tank 16 to the developer tank to maintain the developing solution in tank 12 at the desired concentration and volume.

Similarly, conventional processors comprise a tank 18 for holding a fixer solution through which the film is passed after it travels through the developer tank 12. Replenishment of the solution in tank 18 is accomplished by a pump 20 which is effective to deliver fixer solution from a storage tank 22 to the tank 18. As indicated previously, the amount of developer and the fixer transferred from tanks 16, 22 to the tanks 12, 18, respectively, depends on the quantity (e.g., the number of sheets) of film processed during a predetermined period of time, and on the evaporation of the solutions from tanks 12 and 18. As shown by the dotted lines 24, storage tanks 16 and 22 can be at a location remote from the processor 10 and coupled by suitable conduits to the pumps 14 and 20.

Processor 10 has a film detector 30 for sensing the quantity of film to be processed. Various types of film detectors are known in the art, including detectors that project an infrared light beam across the path of film as it is fed into the processor 10. Mechanical film detectors have also been used. In the following description it will be assumed that the film being processed by the processor 10 comprises sheet film of a standard size, such as 14"×17". With this assumption in mind, it is sufficient for the film detector to be one which will sense the passage of a sheet of film into the processor. Where a variety of different sizes of film sheets are provided to the processor, or where long, continuous rolls of film are processed simultaneously, the film detector can provide a measurement of the area of the film to be processed instead of the number of sheets being processed.

A signal from the film detector is provided to a processor controller generally designated 32. The controller 32 preferably comprises a programmable microprocessor 34. When a signal is provided from the detector to the microprocessor, a film counter 36 is incremented. The microprocessor can reset the counter to zero to initiate a new cycle of operation.

A timer 38 is associated with the microprocessor. The timer is adapter to provide a signal to the micropressor at the end of a predetermined time interval, such as 30 minutes. In response to the receipt of the signal from timer 38, the microprocessor can cause the film counter 36 to be reset to zero.

As explained in more detail later, the processor controller 32 is adapted to adjust the volume of replenishment solution provided by pumps 14 and 20 to the tanks 12 and 18, respectively. This is accomplished by means of a pump volume controller 40 of the processor controller 32. The volume controller 40 will set the replenishment volume based on the number of sheets detected by the detector 30 during a predetermined time period. For example, when the number of 11×14 inch sheets sensed by detector 30 is relatively low, a first relatively large volume of replenishment fluid is provided to each of the tanks 12 and 18. On the other hand, when a relatively high number of sheets are sensed by the detector 30, a second and lower volume of replenishment fluid is provided to each of the tanks 12 and 18. The pump volume controller 40 can adjust the amount of solution provided by pumps 14 and 20 in any suitable manner. For example, the controller can adjust the time that the pumps 14 and 20 operate and thereby adjust the volume of solution provided to the tanks. Also, the controller can be coupled to a sensor in the conduit between the pumps and the respective tanks 12, 14 so that operation of the pumps can be terminated when a predetermined volume of solution has passed the sensors.

Figure 2:
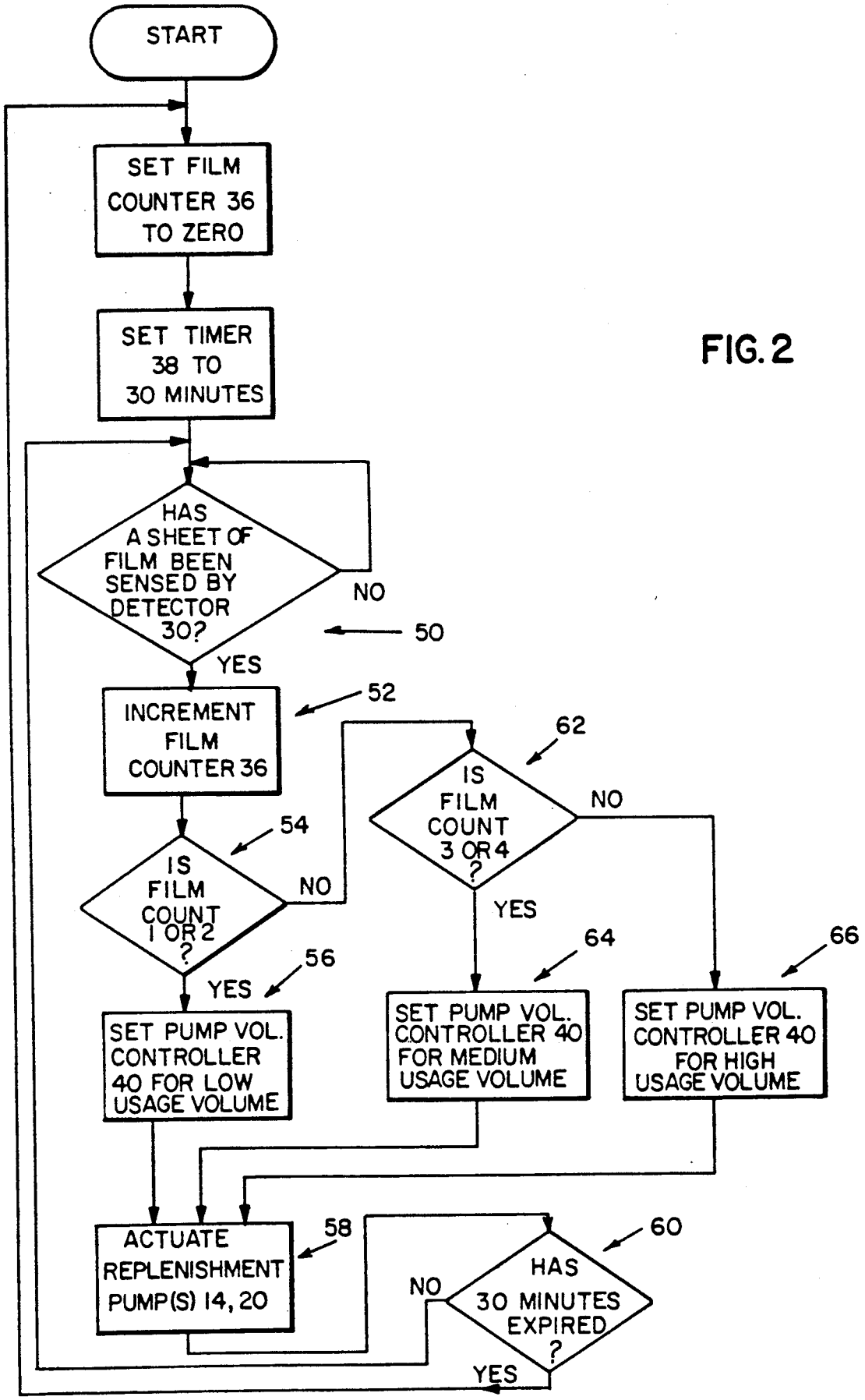
FIG. 2 is a flow diagram illustrating steps in the process of the invention.

FIG. 2 of the drawings is a flow diagram illustrating the process of the invention. This diagram will now be described with reference to the apparatus illustrated in FIG. 1.

When the process is initially started, the film counter 36 is set to zero. By way of example, it will be assumed that the processor controller 32 sets the timer to operate on a 30 minute cycle. It will also be assumed that the controller 32 is programmed to set the pump volume controller 40 operate the pumps 14, 20 to provide different volumes of replenishment solutions to tanks 12, 18 based on the number of sheets of film processed during a 30 minute cycle in accordance with the following table:

| Number of 11 × 14 Sheets | Developer (ml) Per Sheet | Fixer (ml) Per Sheet |
|---|---|---|
| 1,2 | 100 | 120 |
| 3,4 | 80 | 100 |
| More than 4 sheets | 60 | 85 |

These replenishment rates are examples of rates suitable for a processor, and can vary for different models or designs of processors. The rates in the table are consistent with rates in known processors requiring manual adjustment of replenishment rates based on estimated usage.

As shown at 50 in the flow diagram, initially the processor will wait until a film sheet has been sensed by detector 30. When a sheet is sensed, the counter 36 is incremented as shown at 52. Then the microprocessor determines the number of sheets that have been counted by the film counter 36, as shown at 54. If the film count is one or two, then the microprocessor, operating through the pump volume control 40, will set the replenishment volume for pumps 14 and 20 at a relatively low usage volume, as shown at 56. This is the volume shown in the first line of the table above. As a result, when the first and second sheets are detected the replenishment pumps are actuated as shown at 58 so that 100 ml of developer and 120 ml of fixer are added to tanks 12 and 18, respectively. Then the microprocessor 34 interrogates the timer 38 to determine if the 30 minute time period has expired, as shown at 60. If the answer is no, the process waits until another sheet of film has been sensed by detector 30.

When the third and fourth sheets are sensed during a 30 minute time period, as shown at 62, the microprocessor and pump volume controller 40 set the replenishment volume for a medium usage volume as shown at 65, i.e. 80 ml of developer and 100 ml of fixer. This results in actuation of the replenishment pumps, as shown at 58 in the flow chart, to provide the relatively lower volume of replenisher solutions to tanks 12 and 18. Again the microprocessor determines if the 30 minute time period has expired. If not, the process again waits until another sheet is detected.

When more than four sheets have been counted, the microprocessor and pump volume controller set the replenishment volume for a relatively high voltage volume, as shown at 66. Thus for the fifth sheet and all subsequent sheets processed during a 30 minute time period the pumps are effective to deliver 60 ml of developer and 85 ml of fixer to the tanks 12 and 18, respectively. When the 30 minute time period has expired, the counter is reset to zero, as shown at 68, the time is reset to 30 minutes, and the cycle is repeated.

As noted before, some prior methods for replenishment of developer and fixer solutions are based on an estimate of the projected quantity of film to be processed and a manual setting of the output of the replenishment pumps based on that estimate and established manufacturer's recommended volumes for such quantities. Such processes are only as accurate as the estimate and the subsequent setting of the processor, and frequently became inaccurate over a period of time because they are incapable of automatic adjustment for variations in film quantities processed on an hour to hour basis or a day to day basis. The process of the present invention, on the other hand, is based directly on the amount of film being processed in a predetermined time interval and thus is capable of maintaining the proper volume and chemical activity of the processing solutions.

The particular quantity of the replenishment developer and fixer solutions supplied to the tanks 12 and 18, as explained above, are acceptable for one application of the invention. However, it will be understood that the particular quantity of solutions added to the tanks as well as the change in the volumes based on the number of film sheets counted, can be varied from processor to processor based on the apparatus, the kind if film being processed and the manufacturer's recommendations for replenishment rates. Also, as noted before, this system need not be based on the number of sheets counted but, instead, can be controlled on the basis of the calculated area of the film developed over a period of time, or even on the density of the film developed.

The process of the invention is not dependent on the velocity of film through the processor. Thus it is especially suitable for use in film processors that feed film through the processor at two (or more) velocities.

The invention has been described in detail with particular reference to a preferred embodiment thereof, but it will be understood that variations and modifications can be effected within the spirit and scope of the invention.

I claim:

1. A process for replenishing a solution in a film processor wherein a series of film sheets are fed seriatim through a tank containing the solution, the process comprising:

detecting each film sheet fed through the solution.

incrementing a counter each time a film sheet is detected during a predetermined time period, and replenishing the solution in the tank as a function of the number of sheets detected during the time period with the volume of replenishment solution varying from (1) a first volume when the counter indicates a low number of sheets to (2) a second volume different than the first volume when the counter indicates a higher number of sheets.

2. A process as set forth in claim 1 wherein the processor has a second tank for a processing solution and the film sheets are fed seriatim through the second tank after they have been fed through the first tank, and the process further comprising replenishing the solution in the second tank as a function of the number of sheets detected during the time period with the volume of replenishment solution varying from (1) a first volume when the counter indicates a low number of sheets to (2) a second volume different than the first volume when the counter indicates a higher number of sheets.

3. A process as set forth in claim 2 wherein the step of replenishing the solution in the second tank is controlled so that the first and second volumes of replenishment solution provided to the second tank are different from the first and second volumes, respectively, provided to the other tank.

4. A process for replenishing a solution in a film processor wherein a series of film sheets are fed seriatim through a tank containing the solution, the process comprising:

detecting each film sheet fed through the solution, incrementing a counter each time a film sheet is detected during a predetermined time period, and adding a first volume of solution to the tanks each time the counter is incremented until a first predetermined number of sheets has been counted, adding a second and smaller volume of solution to the tank each time the counter is incremented after the first predetermined number of sheets has been counted and until a second predetermined number of sheets has been counted, and adding a third and still smaller volume of solution to the tank each time the counter is incremented after the second predetermined number of sheets has been counted.

5. A process as set forth in claim 4 further comprising resetting the counter to zero at the end of the predetermined time period.

6. A process as set forth in claim 4 wherein the first predetermined number of sheets is two and the second predetermined number of sheets is four.

7. A process as set forth in claim 6 wherein the predetermined time period is about thirty minutes.

* * * * *